US010074380B2

(12) United States Patent
Wung et al.

(10) Patent No.: US 10,074,380 B2
(45) Date of Patent: Sep. 11, 2018

(54) SYSTEM AND METHOD FOR PERFORMING SPEECH ENHANCEMENT USING A DEEP NEURAL NETWORK-BASED SIGNAL

(71) Applicant: Apple Inc., Cupertino, CA (US)

(72) Inventors: Jason Wung, Culver City, CA (US); Ramin Pishehvar, Culver City, CA (US); Daniele Giacobello, Culver City, CA (US); Joshua D. Atkins, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/227,885

(22) Filed: Aug. 3, 2016

(65) Prior Publication Data

US 2018/0040333 A1 Feb. 8, 2018

(51) Int. Cl.
*G10L 21/02* (2013.01)
*G10L 21/0232* (2013.01)
(Continued)

(52) U.S. Cl.
CPC ..... *G10L 21/0232* (2013.01); *G10L 25/30* (2013.01); *G10L 25/87* (2013.01); *G10L 2021/02082* (2013.01)

(58) Field of Classification Search
CPC ..... G10L 21/0208; G10L 2021/02082; G10L 2021/02085; G10L 2021/02087;
(Continued)

(56) References Cited

U.S. PATENT DOCUMENTS 5,621,724 A * 4/1997 Yoshida ..... H04M 9/082 370/290
5,737,485 A * 4/1998 Flanagan ..... G10L 15/16 704/232

(Continued)

FOREIGN PATENT DOCUMENTS

WO 2015/157013 A1 10/2015

OTHER PUBLICATIONS

Schwarz, Andreas et al., "Spectral feature-based nonlinear residual echo suppression", IEEE Workshop on Applications of Signal Processing to Audio and Acoustics, Conference Paper Oct. 20-23, 2013.

(Continued)

*Primary Examiner* — Feng Niu
*Assistant Examiner* — Stephen Brinich
(74) *Attorney, Agent, or Firm* — Womble Bond Dickinson (US) LLP

(57) ABSTRACT

Method for performing speech enhancement using a Deep Neural Network (DNN)-based signal starts with training DNN offline by exciting a microphone using target training signal that includes signal approximation of clean speech. Loudspeaker is driven with a reference signal and outputs loudspeaker signal. Microphone then generates microphone signal based on at least one of: near-end speaker signal, ambient noise signal, or loudspeaker signal. Acoustic-echo-canceller (AEC) generates AEC echo-cancelled signal based on reference signal and microphone signal. Loudspeaker signal estimator generates estimated loudspeaker signal based on microphone signal and AEC echo-cancelled signal. DNN receives microphone signal, reference signal, AEC echo-cancelled signal, and estimated loudspeaker signal and generates a speech reference signal that includes signal statistics for residual echo or for noise. Noise suppressor (Continued)

generates a clean speech signal by suppressing noise or residual echo in the microphone signal based on speech reference signal. Other embodiments are described.

18 Claims, 8 Drawing Sheets

(51) Int. Cl.
*G10L 25/30* (2013.01)
*G10L 25/87* (2013.01)
*G10L 21/0208* (2013.01)

(58) Field of Classification Search
CPC ..... G10L 25/30; G10L 25/33; G10L 25/36; G10L 25/39; G10L 25/27; G10L 25/87; G10L 25/84; G10L 25/81; G10L 2025/786; G10L 21/0232; G10L 21/0224; G10L 21/0216; G10L 2021/02161; G10L 2021/02163; G10L 2021/02165; G10L 2021/02166; G10L 2021/02168
USPC ..... 704/1–2, 10–11, 18–20
See application file for complete search history.

(56) References Cited

U.S. PATENT DOCUMENTS

| | | | | |
|---|---|---|---|---|
| 9,640,194 | B1 * | 5/2017 | Nemala | G10L 21/0208 |
| 2005/0089148 | A1 * | 4/2005 | Stokes, III | H04M 9/082 379/3 |
| 2009/0089053 | A1 * | 4/2009 | Wang | G10L 25/78 704/233 |
| 2010/0057454 | A1 * | 3/2010 | Mohammad | H04M 9/082 704/233 |
| 2011/0194685 | A1 * | 8/2011 | van de Laar | H04M 9/082 379/406.01 |
| 2014/0142929 | A1 | 5/2014 | Seide et al. | |
| 2014/0257803 | A1 | 9/2014 | Yu et al. | |
| 2014/0257804 | A1 | 9/2014 | Li et al. | |
| 2015/0066499 | A1 | 3/2015 | Wang et al. | |
| 2015/0112672 | A1 * | 4/2015 | Giacobello | H04M 9/082 704/233 |
| 2015/0301796 | A1 | 10/2015 | Visser et al. | |
| 2016/0358602 | A1 * | 12/2016 | Krishnaswamy | G10L 15/20 |

OTHER PUBLICATIONS

Bendersky, Diego A. et al., "Nonliner Residual Acoustic Echo Suppresion for High Levels of Harmonic Distortion", in Proc. IEEE ICASSP, 2008.
Caroselli, Joe, "Adaptive Multichannel Dereverberation for Automatic Speech Recognition", in Proc. Interspeech, 2017.
Delcroix, Marc, "Linear Prediction-Based Dereverberation with Advanced Speech Enhancencement and Recognition Technologies for the Reverb Challenge", in Proc. Reverb Workshop, 2014.
Delcroix, Marc, "Speech recognition in living rooms: Integrated speech enhancement and recognition system based on spatial, spectral and temporal modeling of sounds", Computer Speech and Language, vol. 27, No. 3, 2013, 851-873.
Erdogan, H. et al., "Improved MVDR beamforming using single-channel mask prediction networks", in Proc. Interspeech, 2016.
Erdogan, Hakan et al., "Phase-sensitive and recognition-boosted speech separation using deep recurrent neural networks", in Proc. IEEE ICASSP, 2015.
Helwani, Karim et al., "Source-domain adaptive filtering for MIMO systems with application to acoustic echo cancellation", in Proc. IEEE HSCMA, 2010.
Heymann, Jahn et al., "Neural Network Based Spectral Mask Estimation for Acoustic Beamforming", in Proc. IEEE ICASSP, 2016.
Higuchi, Takuya et al., "Robust MVDR Beamforming Using Time-Frequency Masks for Online/Offline ASR in Noise", in Proc. IEEE ICASSP, 2016.
Huang, Yiteng et al., "Bi-magnitude processing framework for nonlinear acoustic echo cancellation on android devices", in Proc. IEEE IAWENC, 2016.
Jukic, Ante et al., "Adaptive Speech Dereverberation Using Constrained Sparse Multichannel Linear Prediction", IEEE Signal Processing Letters, vol. 24, No. 1, 2017, 101-105.
Jukic, Ante et al., "Group Sparsity for MIMO Speech Dereverberation", in Proc. IEEE WASPA, 2015.
Jukic, Ante et al., "Multi-channel linear prediction-based speech dereverberation with sparse priors", IEEE/ACM Transactions on Audio, Speech, and Language Processing, vol. 23, No. 9, 2015, 1509-1520.
Lee, Chul M. et al., "DNN-based Residual Echo Suppression", in Proc. Interspeech, 2015.
Li, Bo et al., "Acoustic Modeling for Google Home", in Proc. Interspeech, 2017.
Malik, Sarmad et al., "Variationally Diagonalized Multichannel State-Space Frequency-Domain Adaptive Filtering for Acoustic Echo Cancellation", in Proc. IEEE ICASSP, 2013.
Narayanan, Arun et al., "Improving Robustness of Deep Neural Network Acoustic Models via Speech Separation and Joint Adaptive Training", IEEE Transactions on Audio, Speech, and Language Processing, vol. 23, No. 1, 2015, 92-101.
Ono, Nobutaka, "Auxiliary-function-based Independent Vector-norm Type Weighting Functions", in Proc. APSIPA, 2012.
Ono, Nobutaka, "Stable and Fast Update Rules for Independent Vector Analysis Based on Auxiliary Function Technique", in Proc. IEEE WASPAA, 2011.
Schwartz, Boaz et al., "Online Speech Dereverberation Using Kalman Filter and EM Algorithm", IEEE/ACM Transactions on Audio, Speech, and Language Processing, vol. 23. No. 2, 2015, 394-406.
Schwarz, Andreas et al., "Combined nonlinear echo cancellation and residual echo suppression", in Proc. Speech Communication; 11th ITG Symposium, 2014.
Schwarz, Andreas et al., "Spectral Feature-Based Nonlinear Residual Echo Suppression", in Proc. IEEE WASPAA, 2013.
Sondhi, M. M., "Stereophonic Acoustic Echo Cancellation—An Overview of the Fundamental Problem", IEEE Signal Processing Letters, vol. 2, No. 8 1995, 148-151.
Souden, Mehrez, "A Multichannel MMSE-Based Framework for Speech Source Separation and Noise Reduction", IEEE Transactions on Audio, Speech, and Language Processing, vol. 21, No. 9, 2013, 1913-1928.
Souden, Mehrez et al., "An integrated solution for online multichannel noise tracking and reduction", IEEE Transactions on Audio, Speech, and Language Processing, vol. 19, No. 7, 2011, 2159-2169.
Souden, Mehrez et al., "On Optimal Frequency-Domain Multichannel Linear Filtering for Noise Reduction", IEEE Transactions on Audio, Speech, and Language Processing, 2010, 260-276.
Taniguchi, Toru et al., "An Auxiliary-Function Approach to Online Independent Vector Analysis", in Proc. IEEE HSCMA, 2014.
Wang, Ziteng et al., "Rank-1 Constrained Multichannel Wiener Filter for Speech Recognition in Noisy Environments", Computer Speech and Language, vol. 49, 2018, 31-51.
Xiao, Xiong et al., "On Time-Frequency Mask Estimation for MVDR Beamforming with Application in Robust Speech Recognition", in Proc. IEEE ICASSP, 2017.
Xu, Yong et al., "A Regression Approach to Speech Enhancement Based on Deep Neural Networks", IEEE/ACM Transactions on Audio, Speech, and Language Processing, vol. 23, No. 1, 2015, 7-19.
Yoshioka, T. et al., "Making Machines Understand Us in Reverberant Rooms [Robustness against reverberation for automatic speech recognition]", IEEE Signal Processing Magazine, vol. 29, No. 6, 2012, 114-126.
Yoshioka, Takuta et al., "Dereverberation for Reverberation-Robust Microphone Arrays", in Proc. IEEE EUSIPCO, 2013.
Yoshioka, Takuya et al., "Generalization of Multi-Channel Linear Prediction Methods for Blind MIMO Impulse Response Shorten-

(56) References Cited

OTHER PUBLICATIONS ing", IEEE Transactions on Audio, Speech, and Language Processing, vol. 20, No. 10, 2012, 2707-2720.
Yoshioka, Takuya et al., "The NTT Chime-3 System: Advances in Speech Enhancement and Recognition for Mobile Multi-Microphone Devices", in Proc. IEEE Automatic Speech Workshop, 2015.

* cited by examiner

SYSTEM AND METHOD FOR PERFORMING SPEECH ENHANCEMENT USING A DEEP NEURAL NETWORK-BASED SIGNAL

FIELD

An embodiment of the invention relate generally to a system and method for performing speech enhancement using a deep neural network-based signal.

BACKGROUND

Currently, a number of consumer electronic devices are adapted to receive speech from a near-end talker (or environment) via microphone ports, transmit this signal to a far-end device, and concurrently output audio signals, including a far-end talker, that are received from a far-end device. While the typical example is a portable telecommunications device (mobile telephone), with the advent of Voice over IP (VoIP), desktop computers, laptop computers and tablet computers may also be used to perform voice communications.

When using these electronic devices, the user also has the option of using the speakerphone mode, at-ear handset mode, or a headset to receive his speech. However, a common complaint with any of these modes of operation is that the speech captured by the microphone port or the headset includes environmental noise, such as wind noise, secondary speakers in the background, or other background noises. This environmental noise often renders the user's speech unintelligible and thus, degrades the quality of the voice communication. Additionally, when the user's speech is unintelligible, further processing of the speech that is captured also suffers. Further processing may include, for example, automatic speech recognition (ASR).

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
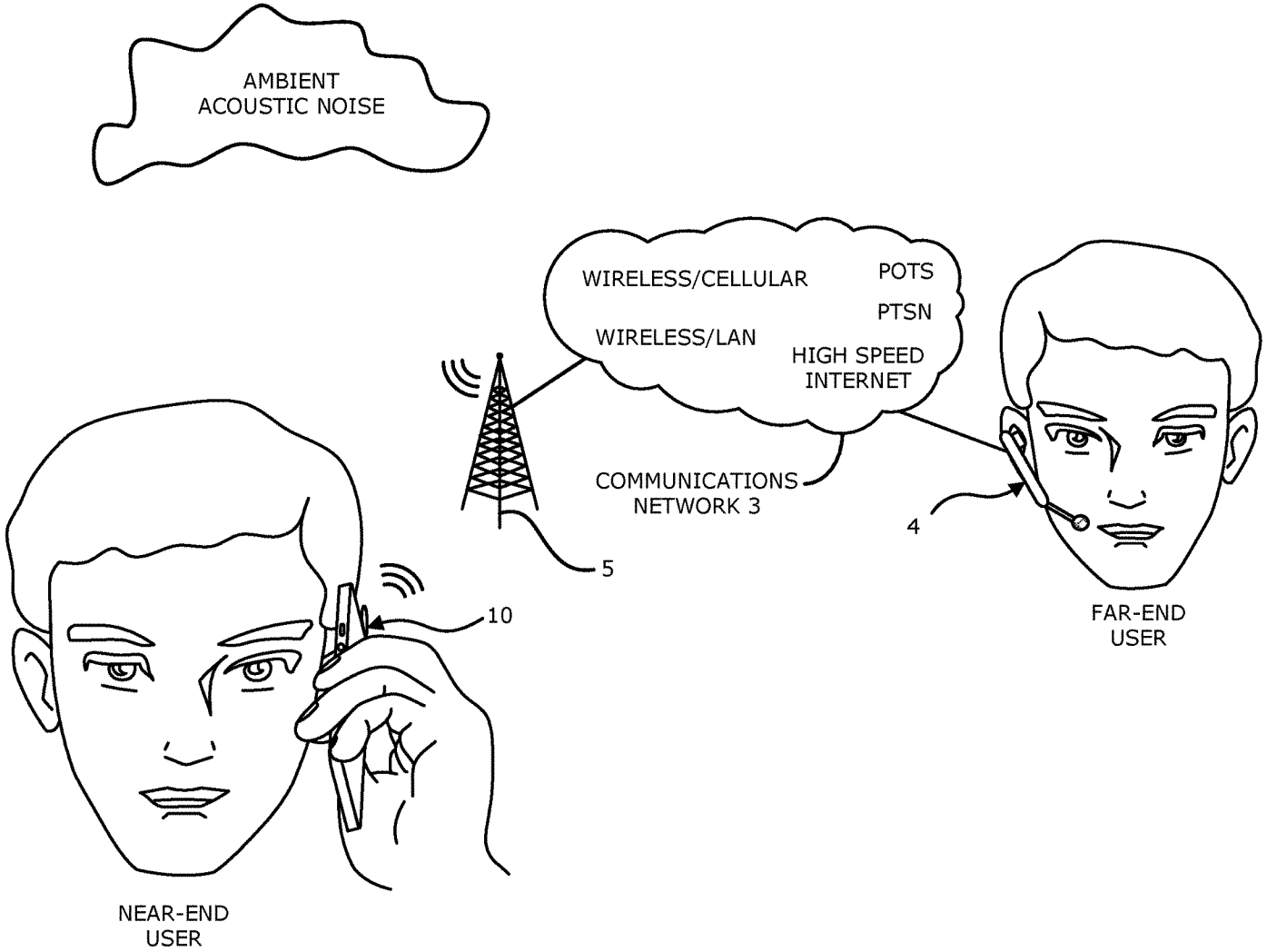
FIG. 1 depicts near-end user and a far-end user using an exemplary electronic device in which an embodiment of the invention may be implemented.

FIG. 1 depicts near-end user and a far-end user using an exemplary electronic device in which an embodiment of the invention may be implemented. The electronic device 10 may be a mobile communications handset device such as a smart phone or a multi-function cellular phone. The sound quality improvement techniques using double talk detection and acoustic echo cancellation described herein can be implemented in such a user audio device, to improve the quality of the near-end audio signal. In the embodiment in FIG. 1, the near-end user is in the process of a call with a far-end user who is using another communications device 4. The term "call" is used here generically to refer to any two-way real-time or live audio communications session with a far-end user (including a video call which allows simultaneous audio). The electronic device 10 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

While not shown, the electronic device 10 may also be used with a headset that includes a pair of earbuds and a headset wire. The user may place one or both the earbuds into his ears and the microphones in the headset may receive his speech. The headset 100 in FIG. 1 is shown as a double-earpiece headset. It is understood that single-earpiece or monaural headsets may also be used. As the user is using the headset or directly using the electronic device to transmit his speech, environmental noise may also be present (e.g., noise sources in FIG. 1). The headset may be an in-ear type of headset that includes a pair of earbuds which are placed inside the user's ears, respectively, or the headset may include a pair of earcups that are placed over the user's ears may also be used. Additionally, embodiments of the present disclosure may also use other types of headsets. Further, in some embodiments, the earbuds may be wireless and communicate with each other and with the electronic device 10 via BlueTooth™ signals. Thus, the earbuds may not be connected with wires to the electronic device 10 or between them, but communicate with each other to deliver the uplink (or recording) function and the downlink (or playback) function.

Figure 2:
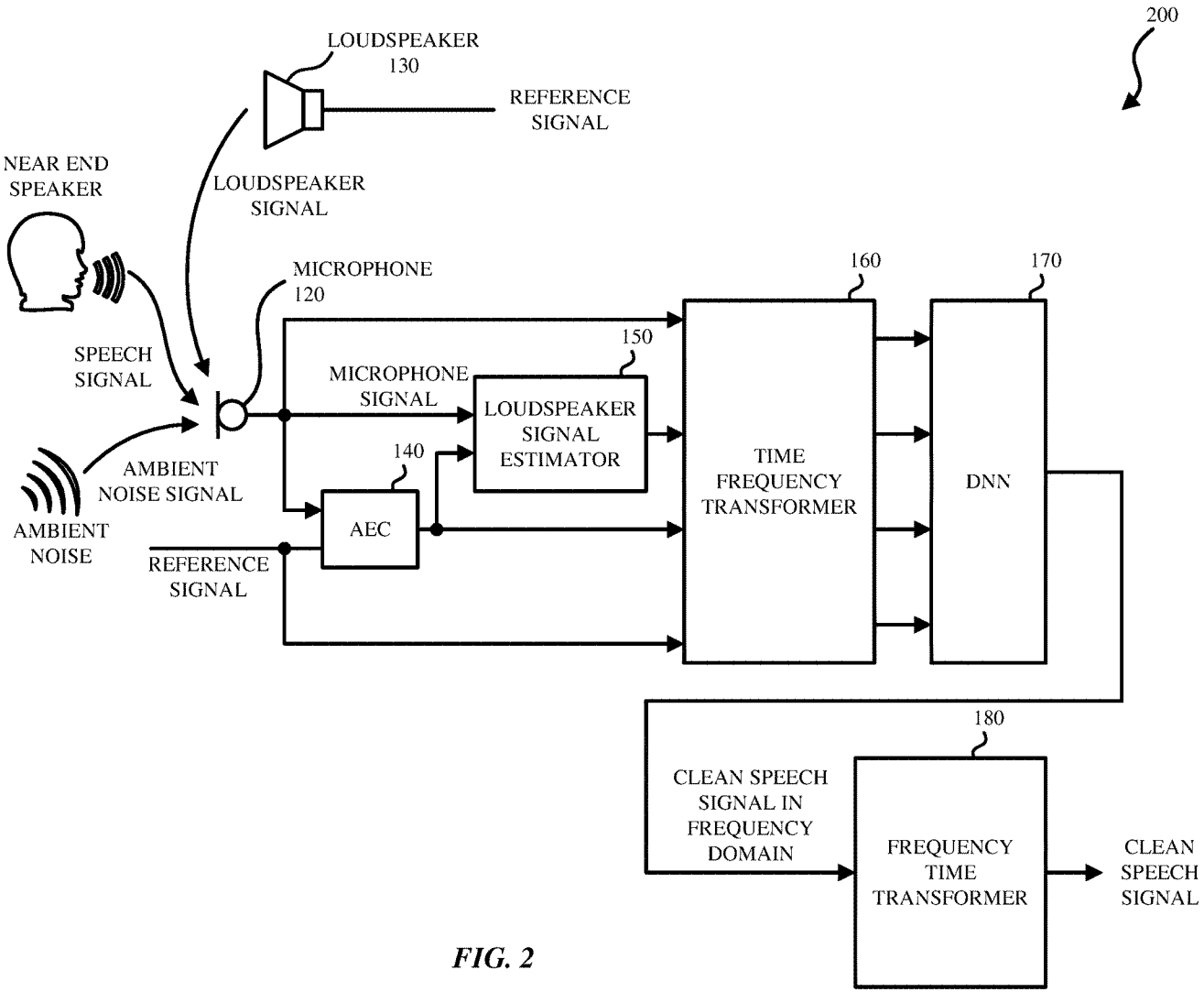
FIG. 2 illustrates a block diagram of a system for performing speech enhancement using a deep neural network-based signal according to one embodiment of the invention.

FIG. 2 illustrates a block diagram of a system 200 for performing speech enhancement using a Deep Neural Network (DNN)-based signal according to one embodiment of the invention. System 200 may be included in the electronic device 10 and comprises a microphone 120 and a loudspeaker 130. While the system 200 in FIG. 2 includes only one microphone 120, it is understood that at least one of the microphones in the electronic device 10 may be included in the system 200. Accordingly, a plurality of microphone 120 may be included in the system 200. It is further understood that the at least one microphone 120 may be included in a headset used with the electronic device 10.

The microphone 120 may be an air interface sound pickup device that converts sound into an electrical signal. As the near-end user is using the electronic device 10 to transmit his speech, ambient noise may also be present. Thus, the microphone 120 captures the near-end user's speech as well as the ambient noise around the electronic device 10. A reference signal may be used to drive the loudspeaker 130 to generate a loudspeaker signal. The loudspeaker signal that is output from a loudspeaker 130 may also be a part of the environmental noise that is captured by the microphone, and if so, the loudspeaker signal that is output from the loudspeaker 130 could get fed back in the near-end device's microphone signal to the far-end device's downlink signal. This loudspeaker signal would in part drive the far-end device's loudspeaker, and thus, components of this loudspeaker signal would include near-end device's microphone signal to the far-end device's downlink signal as echo. Thus, the microphone 120 may receive at least one of: a near-end talker signal (e.g., a speech signal), an ambient near-end noise signal, or a loudspeaker signal. The microphone 120 generates and transmits a microphone signal (e.g., acoustic signal).

In one embodiment, system 200 further includes an acoustic echo canceller (AEC) 140 that is a linear echo canceller. For example, the AEC 140 may be an adaptive filter that linearly estimate echo to generate a linear echo estimate. In some embodiments, the AEC 140 generates an echo-cancelled signal using the linear echo estimate. In FIG. 2, the AEC 140 receives the microphone signal from the microphone 120 and the reference signal that drives the loudspeaker 130. The AEC 140 generates an echo-cancelled signal (e.g., AEC echo-cancelled signal) based on the microphone signal and the reference signal.

System 200 further includes a loudspeaker signal estimator 150 that receives the microphone signal from the microphone 120 and the AEC echo-cancelled signal from the AEC 140. The loudspeaker signal estimator 150 uses the microphone signal and the AEC echo-cancelled signal to estimate the loudspeaker signal that is received by the microphone 120. The loudspeaker signal estimator 150 generates a loudspeaker signal estimate.

In FIG. 2, system 200 also includes a time-frequency transformer 160, a DNN 170, and a frequency-time transformer 180. The time-frequency transformer 160 receives the microphone signal, the loudspeaker signal estimate, the AEC echo-cancelled signal and the reference signal in the time domain and transforms the signals into the frequency domain. In one embodiment, the time-frequency transformer 160 performs a Short-Time Fourier Transform (STFT) on the microphone signal, the loudspeaker signal estimate, the AEC echo-cancelled signal and the reference signal in the time domain to obtain the frequency domain. The time-frequency representation may include a windowed or unwindowed Short-Time Fourier Transform or a perceptual weighted domain such as Mel frequency bins or gammatone filter bank. In some embodiments, the microphone signal, the reference signal, the AEC echo-cancelled signal and the estimated loudspeaker signal in the frequency domain are complex signals including a magnitude component and a phase component. In this embodiment, the complex time-frequency representation may also include phase features such as baseband phase difference, instantaneous frequency (e.g., first time-derivative of the phase spectrum), relative phase shift, etc.

The DNN 170 in FIG. 2 is trained offline by exciting the at least one microphone using a target training signal that includes a signal approximation of clean speech. In one embodiment, a plurality of target training signals are used to excite the microphone to train the DNN 170. In some embodiments, during offline training, the target training signal that includes the signal approximation of clean speech (e.g., ground truth target) is then mixed with at least one of a plurality of signals including a training microphone signal, a training reference signal, the training AEC echo-cancelled signal, and a training estimated loudspeaker signal. The training microphone signal, the training reference signal, the training AEC echo-cancelled signal, and the training estimated loudspeaker signal may replicate a variety of environments in which the device 10 is used and near-end speech is captured by the microphone 120. In some embodiments, the target training signal includes the signal approximation of the clean speech as well as a second target. The second target may include at least one of: a training noise signal or a training residual echo signal. In this embodiment, during offline training, the target training signal including the signal approximation of the clean speech and the second target may vary to replicate the variety of environments in which the device 10 is used and the near-end speech is captured by the microphone 120. In another embodiment, the output of the DNN 170 may be a training gain function (e.g., an oracle gain function or an signal approximation of the gain function) to be applied to the noise speech signal instead of a signal approximation of the clean speech signal. The DNN 170 may be for example a deep feed-forward neural network, a deep recursive neural network, or a deep convolutional neural network. Using the mixed signal, which includes the signal approximation of clean speech, the DNN 170 is trained with an overall spectral information. In other words, the DNN 170 may be trained to generate the clean speech signal and estimate the nonlinear echo, residual echo, and near-end noise power level using the overall spectral information. In some embodiments, the training offline of the DNN 170 may include establishing the training loudspeaker signal as a cost function of the signal approximation of clean speech (e.g., ground truth target). In some embodiments, the cost function is a fixed weighted cost function that is established based on the signal approximation of clean speech (e.g., ground truth target). In other embodiments, the cost function is an adaptive weighted cost function such that the perceptual weighting can be adaptive for each frame of the clean speech training data. In one embodiment, training the DNN 170 includes setting a weight parameter in the DNN 170 based on the target training signal that includes the signal approximation of clean speech (e.g., ground truth target). In one embodiment, the weight parameters in the DNN 170 may also be sparsified and/or quantized from a fully connected DNN.

Once the DNN 170 is trained offline, the DNN 170 in FIG. 2 receives the microphone signal, the reference signal, the AEC echo-cancelled signal, and an estimated loudspeaker signal in the frequency domain from the time-frequency transformer 160. In the embodiment in FIG. 2, the DNN 170 generates a clean speech signal in the frequency domain. In some embodiments, the DNN 170 may determine and generate statistics for residual echo and ambient noise. For example, the DNN 170 may determine and generate an estimate of non-linear echo in the microphone signal that is not cancelled by the AEC 140, an estimate of residual echo in the microphone signal, or an estimate of ambient noise power level in the microphone signal. In this embodiment, the DNN 170 may use these statistics to generate the clean speech signal in the frequency domain. Using the DNN 170 that has been trained offline to see the overall spectral information, the clean speech signal generated does not contain any musical artifact. In other words, the estimate of the residual echo and the noise power that are determined and generated by the DNN 170 are not calculated for each frequency bin independently such that the musical noise artifact due to wrong estimations are avoided.

Using the DNN 170 has the advantage that the system 200 is able address the non-linearities in the electronic device 10 and suppress the noise and linear and non-linear echoes in the microphone signal accordingly. For instance, the AEC 140 is only able to address the linear echoes in the microphone signal such that the AEC 140's performance may suffer from the non-linearity from the electronic device 10.

Further, a traditional residual echo power estimator that is used in lieu of the DNN 170 in conventional systems may also not reliably estimate the residual echo due to the non-linearities that are not addressed by the AEC 140. Thus, in conventional systems, this would result in residual echo leakage. The DNN 170 is able to accurately estimate the residual echo in the microphone signal even during double-talk situations given the higher near-end speech quality during double-talk situations. The DNN 170 is also able to accurately estimate the near-end noise power level to minimize the impairment to near-end speech after noise suppression.

The frequency-time transformer 180 then receives the clean speech signal in frequency domain from the DNN 170 and performs an inverse transformation to generate a clean speech signal in the time domain. In one embodiment, the frequency-time transformer 180 performs an Inverse Short-Time Fourier Transform (STFT) on the clean speech signal in frequency domain to obtain the clean speech signal in the time domain.

Figure 3:
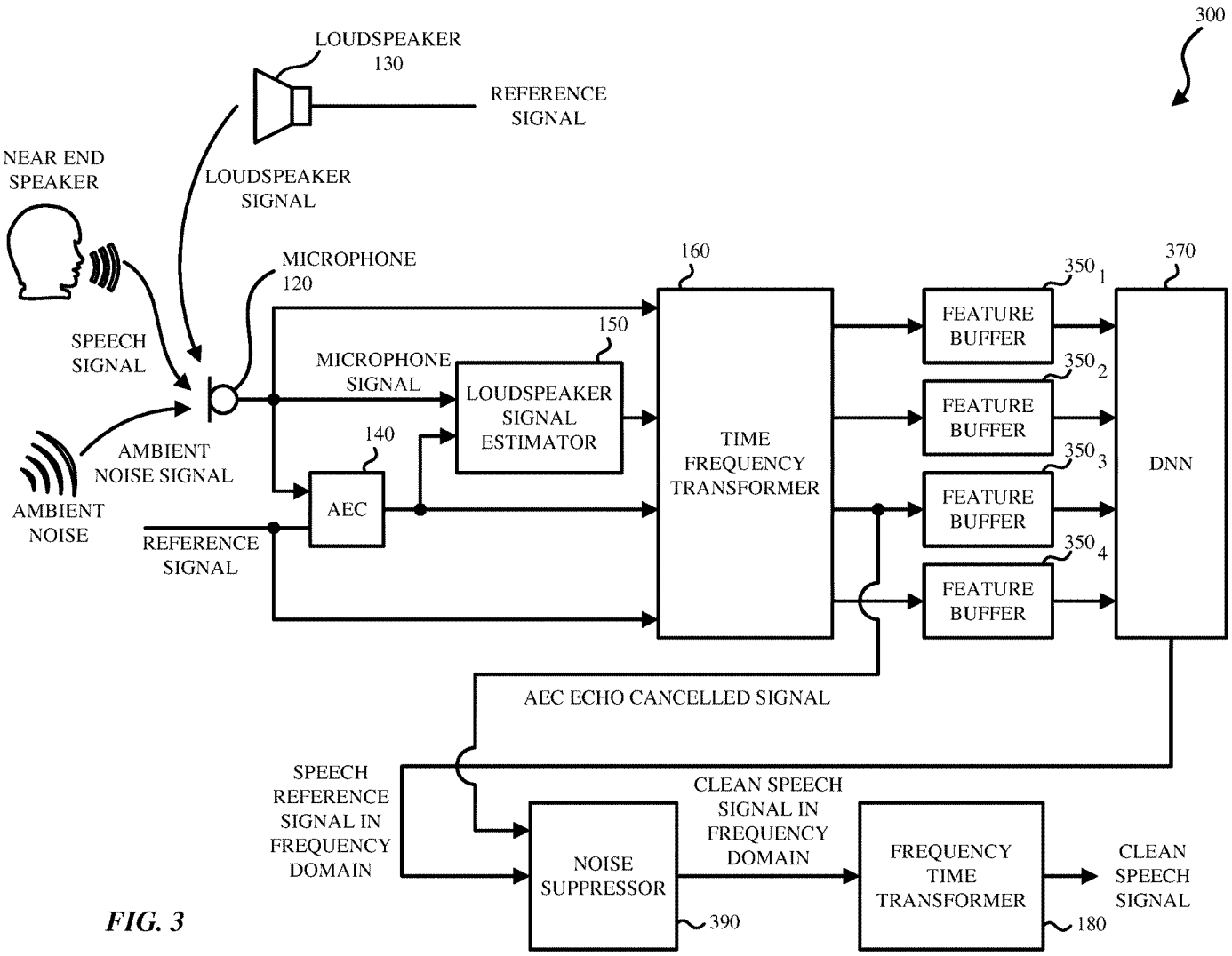
FIG. 3 illustrates a block diagram of a system for performing speech enhancement using a deep neural network-based signal according to one embodiment of the invention.

FIG. 3 illustrates a block diagram of a system for performing speech enhancement using a deep neural network-based signal according to one embodiment of the invention. The system 300 in FIG. 3 further adds to the elements included in system 200 from FIG. 2. In FIG. 3, the microphone signal, the reference signal, the AEC echo-cancelled signal, and the estimated loudspeaker signal in the frequency domain is received by a plurality of feature buffers $\mathbf{350}_1$-$\mathbf{350}_4$, respectively, from the time-frequency transformer 160. Each of the feature buffers $\mathbf{350}_1$-$\mathbf{350}_4$ respectively buffers and transmits the reference signal, the AEC echo-cancelled signal, and the estimated loudspeaker signal in the frequency domain to the DNN 370. In some embodiments, a single feature buffer may be used instead of the plurality of separate feature buffers $\mathbf{350}_1$-$\mathbf{350}_4$. In contrast to FIG. 2, rather than generate and transmit a clean speech signal in the frequency domain, the DNN 370 in system 300 in FIG. 3 generates and transmits a speech reference signal in the frequency domain. In this embodiment, the speech reference signal may include signal statistics for residual echo or signal statistics for noise. For example, the speech reference signal that includes signal statistics for residual echo or signal statistics for noise includes at least one of: an estimate of non-linear echo in the microphone signal that is not cancelled by the AEC 140, an estimate of residual echo in the microphone signal, or an estimate of ambient noise power level in the microphone signal. In some embodiments, the speech reference signal may include a noise and residual echo reference input.

As shown in FIG. 3, the DNN 370 transmits the speech reference signal to a noise suppressor 390. In one embodiment, the noise suppressor 390 may also receive the AEC echo-cancelled signal in the frequency domain from the time-frequency transformer 160. The noise suppressor 390 suppresses the noise or residual echo in the AEC echo-cancelled signal based on the speech reference and outputs a clean speech signal in the frequency domain to the frequency-time transformer 180. As in FIG. 2, the frequency-time transformer 180 in FIG. 3 transforms the clean speech signal in the frequency domain to a clean speech signal in the time domain.

Figure 4:
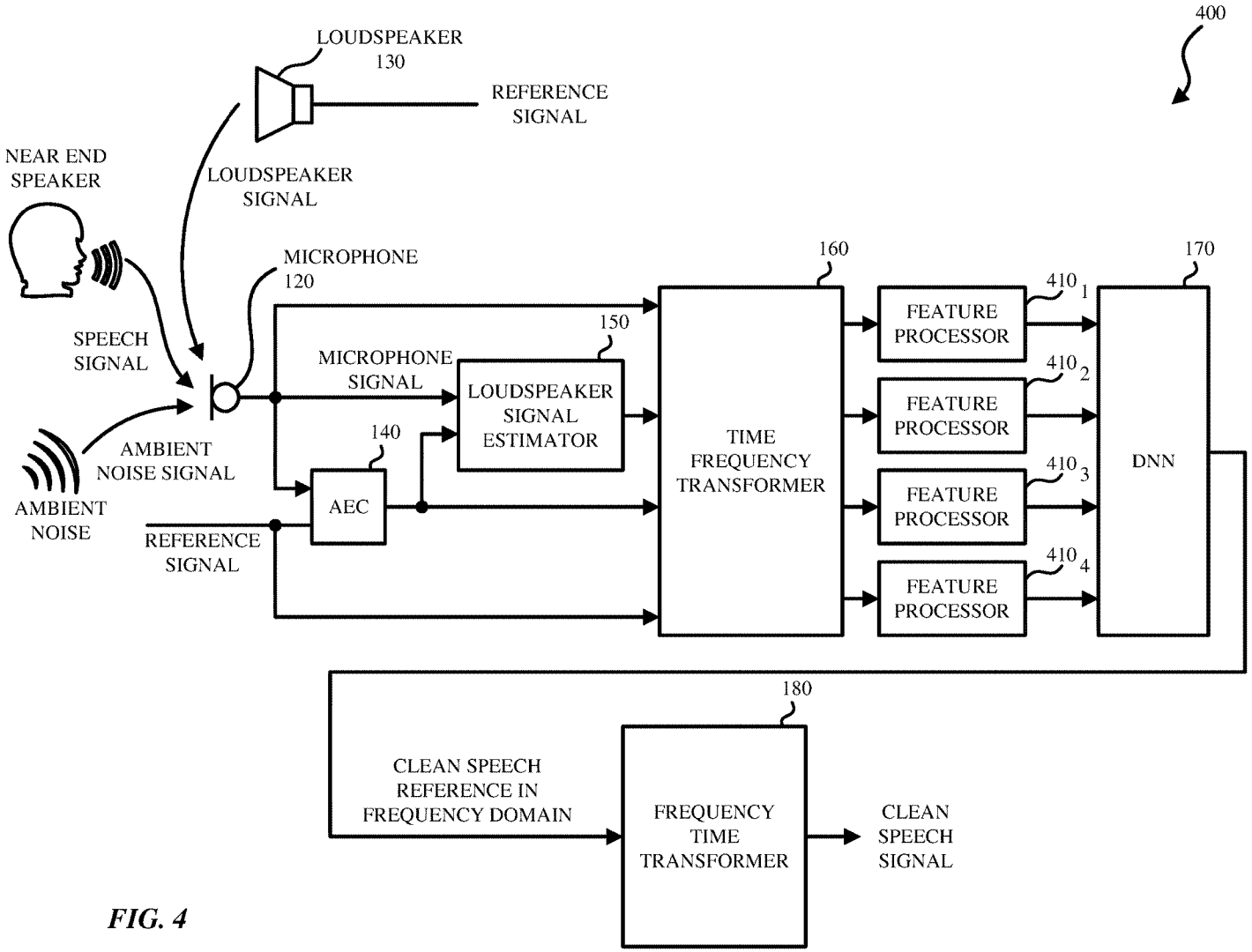
FIG. 4 illustrates a block diagram of a system performing speech enhancement using a deep neural network-based signal according to an embodiment of the invention.
Figure 5:
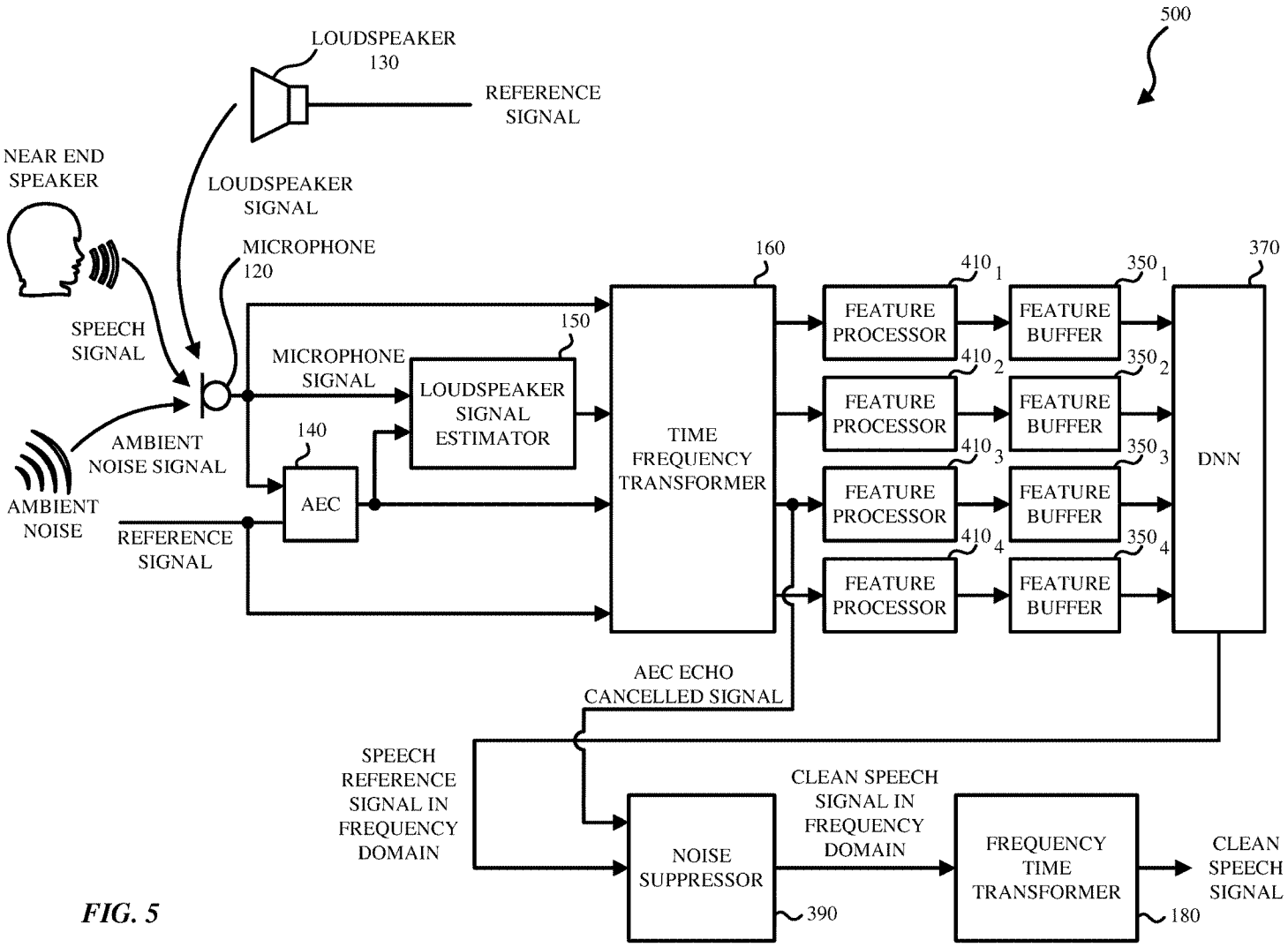
FIG. 5 illustrates a block diagram of a system performing speech enhancement using a deep neural network-based signal according to an embodiment of the invention.

FIGS. 4-5 respectively illustrate block diagrams of systems 400 and 500 performing speech enhancement using a deep neural network-based signal according to embodiments of the invention. System 400 and system 500 include the elements from system 200 and 300, respectively, but further include a plurality of feature processors $\mathbf{410}_1$-$\mathbf{410}_4$ that respectively process and transmit features of the microphone signal, the reference signal, the AEC echo-cancelled signal and the estimated loudspeaker signal to the DNN 170, 370.

Figure 6:
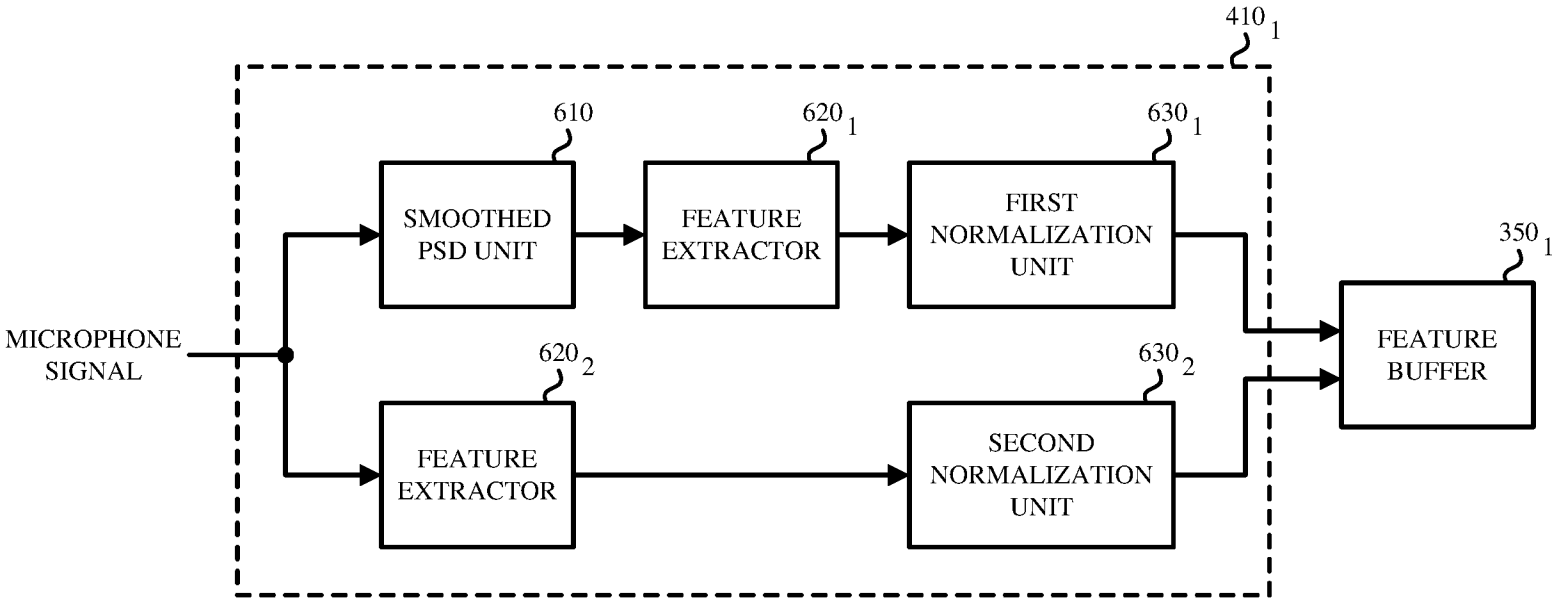
FIG. 6 illustrates a block diagram of the details of one feature processor included in the systems in FIGS. 4-5 for performing speech enhancement using a deep neural network-based signal according to an embodiment of the invention.

In both the systems 400 and 500, each feature processor $\mathbf{410}_1$-$\mathbf{410}_4$ respectively receives the microphone signal, the reference signal, the AEC echo-cancelled signal and the estimated loudspeaker signal in the frequency domain from the time-frequency transformer 160. FIG. 6 illustrates a block diagram of the details of one feature processor $\mathbf{410}_1$ included in the systems in FIGS. 4-5 for performing speech enhancement using a deep neural network-based signal according to an embodiment of the invention. It is understood that while the processor $\mathbf{410}_1$ that receives the microphone signal is illustrated in FIG. 6, each of the feature processors $\mathbf{410}_1$-$\mathbf{410}_4$ may include the elements illustrated in FIG. 6.

As shown in FIG. 6, each of the feature processors $\mathbf{410}_1$-$\mathbf{410}_4$ includes a smoothed power spectral density (PSD) unit 610, a first and a second feature extractor $\mathbf{620}_1$, $\mathbf{630}_2$, and a first and a second normalization unit $\mathbf{630}_1$, $\mathbf{630}_2$. The smoothed PSD unit 610 receives an output from the time-frequency transformer and calculates a smoothed PSD which is output to the first feature extractor $\mathbf{620}_1$. The first feature extractor $\mathbf{620}_1$ extracts the feature using the smoothed PSD. In one embodiment, the first feature extractor $\mathbf{620}_1$ receives the smoothed PSD, computes the magnitude squared of the input bins and then computes a log transform of the magnitude squared of the input bins. The extracted feature that is output of the first feature extractor $\mathbf{620}_1$ is then transmitted to the first normalization unit $\mathbf{630}_1$ which normalizes the output of the first feature extractor $620_1$. In some embodiments, the first normalization unit $630_1$ normalizes using a global mean and variance from training data. The second feature extractor $620_2$ extracts the feature (e.g., the microphone signal) using the output from the time-frequency transformer 160. The second feature extractor $620_2$ receives the output from the time-frequency transformer 160 and extracts the feature by computing the magnitude squared of the input bins and then computing a log transform of the magnitude squared of the input bins. The extracted feature that is output of the second feature extractor $620_2$ is then transmitted to the second normalization unit $630_2$ that normalizes the feature using a global mean and variance from training data. In some embodiments, the microphone signal, the reference signal, the AEC echo-cancelled signal and the estimated loudspeaker signal in the frequency domain are complex signals including a magnitude component and a phase component. In this embodiment, the complex time-frequency representation may also include phase features such as baseband phase difference, instantaneous frequency (e.g., first time-derivative of the phase spectrum), relative phase shift, etc. In one embodiment, the first and second normalizing units $630_1$, $630_2$ are normalizing using a global complex mean and variance from training data.

The feature normalization may be calculated based on the mean and standard deviation of the training data. The normalization may be performed over a whole feature dimensions or on a per feature dimension basis or a combination thereof. In one embodiment, the mean and standard deviation may be integrated into the weights and biases of the first and output layers of the DNN 170 to reduce computational complexity.

Referring back to FIG. 5, each of the feature buffers $350_1$-$350_4$ receives the outputs of the first and second normalization units $630_1$, $630_2$ from each of the feature processors $410_1$-$410_4$. Each of the feature buffers $350_1$-$350_4$ may stack (or buffer) the extracted features, respectively, with a number of past or future frames.

As an example, in FIG. 6, the feature processor $410_1$ that receives the microphone signal (e.g., acoustic signal) in the frequency domain from the time-frequency transformer 160. The smoothed PSD unit 610 in feature processor $410_1$ calculates the smoothed PSD and the first normalization unit $630_1$ normalizes the smoothed PSD of the feature of the microphone signal. The feature extractor 620 in the feature processor $410_1$ extracts the feature of the microphone signal and the second normalization unit $630_2$ normalizes the feature of the microphone signal. Referring back to FIG. 5, the feature buffer $350_1$ stacks the extracted feature of the microphone signal with a number of past or future frames. In one embodiment, one signal feature buffer that buffers each of the extracted features may replace the plurality of feature buffers 3501-3504 in FIG. 5.

The following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 7:
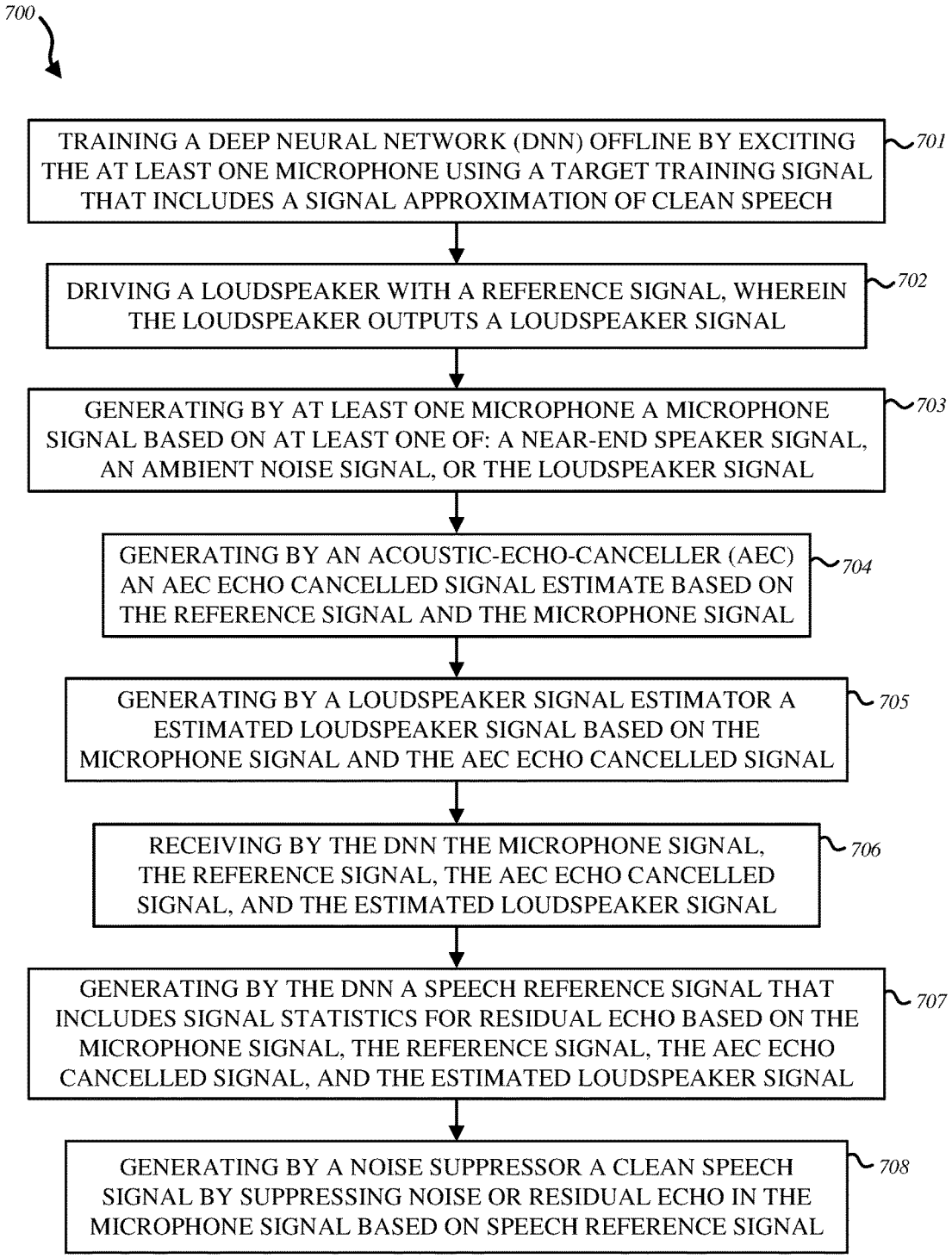
FIG. 7 illustrates a flow diagram of an example method for performing speech enhancement using a deep neural network-based signal according to an embodiment of the invention.

FIG. 7 illustrates a flow diagram of an example method 700 for performing speech enhancement using a Deep Neural Network (DNN)-based signal according to an embodiment of the invention.

The method 700 starts at Block 701 with training a DNN offline by exciting at least one microphone using a target training signal that includes a signal approximation of clean speech. At Block 702, a loudspeaker is driven with a reference signal and the loudspeaker outputs a loudspeaker signal. At Block 703, the at least one microphone generates a microphone signal based on at least one of: a near-end speaker signal, an ambient noise signal, or the loudspeaker signal. At Block 704, an AEC generates an AEC echo-cancelled signal based on the reference signal and the microphone signal. At Block 705, a loudspeaker signal estimator generates an estimated loudspeaker signal based on the microphone signal and the AEC echo-cancelled signal. At Block 706, the DNN receives the microphone signal, the reference signal, the AEC echo-cancelled signal, and the estimated loudspeaker signal and at Block 707, the DNN generates a speech reference signal that includes signal statistics for residual echo or signal statistics for noise based on the microphone signal, the reference signal, the AEC echo-cancelled signal, and the estimated loudspeaker signal. In one embodiment, the speech reference signal that includes signal statistics for residual echo or signal statistics for noise includes at least one of: an estimate of non-linear echo in the microphone signal that is not cancelled by the AEC, an estimate of residual echo in the microphone signal, or an estimate of ambient noise power level in the microphone signal. At Block 708, a noise suppressor generates a clean speech signal by suppressing noise or residual echo in the microphone signal based on speech reference signal.

Figure 8:
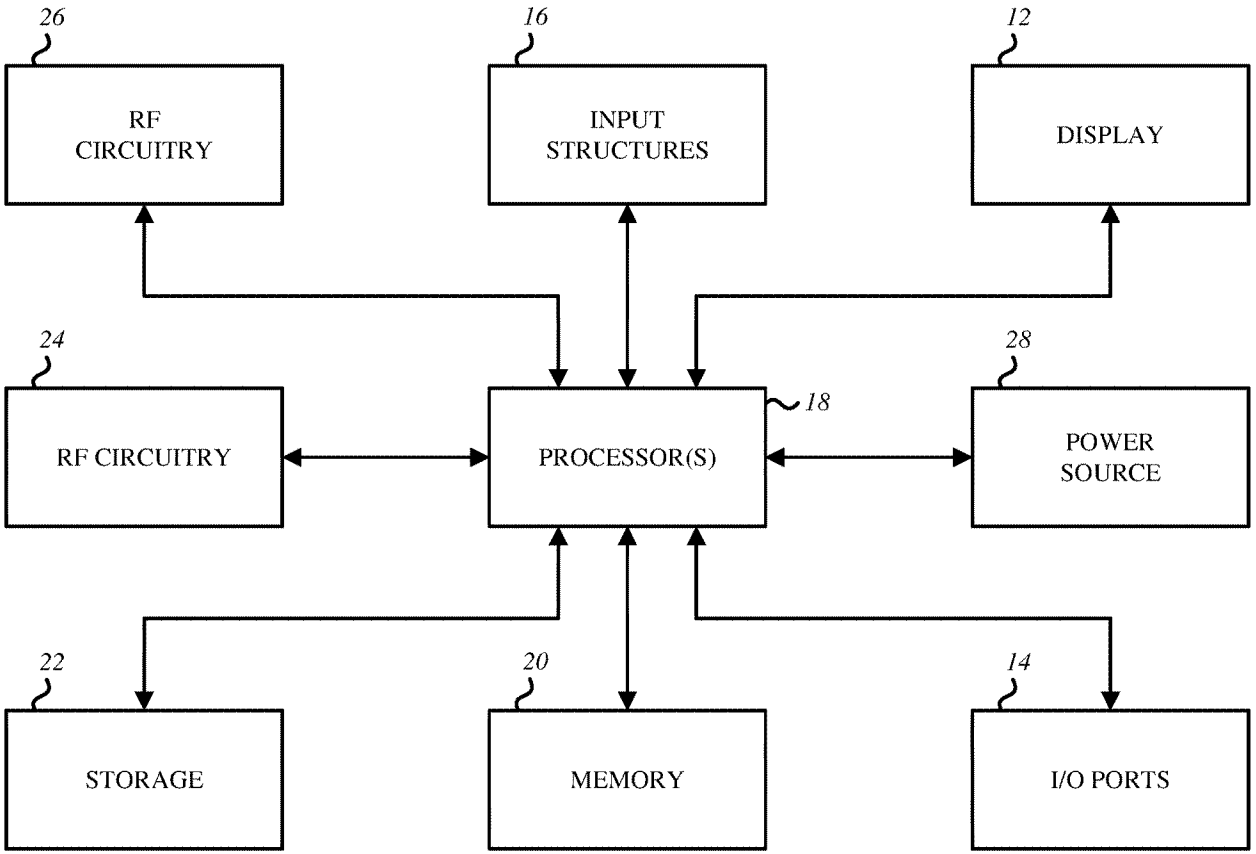
FIG. 8 is a block diagram of exemplary components of an electronic device included in the system in FIGS. 2-5 for performing speech enhancement using a deep neural network-based signal in accordance with aspects of the present disclosure.

FIG. 8 is a block diagram of exemplary components of an electronic device included in the system in FIGS. 2-5 for performing speech enhancement using a Deep Neural Network (DNN)-based signal in accordance with aspects of the present disclosure. Specifically, FIG. 8 is a block diagram depicting various components that may be present in electronic devices suitable for use with the present techniques. The electronic device 10 may be in the form of a computer, a handheld portable electronic device such as a cellular phone, a mobile device, a personal data organizer, a computing device having a tablet-style form factor, etc. These types of electronic devices, as well as other electronic devices providing comparable voice communications capabilities (e.g., VoIP, telephone communications, etc.), may be used in conjunction with the present techniques.

Keeping the above points in mind, FIG. 8 is a block diagram illustrating components that may be present in one such electronic device 10, and which may allow the device 10 to function in accordance with the techniques discussed herein. The various functional blocks shown in FIG. 8 may include hardware elements (including circuitry), software elements (including computer code stored on a computer-readable medium, such as a hard drive or system memory), or a combination of both hardware and software elements. It should be noted that FIG. 8 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 22, expansion card(s) 24, RF circuitry 26, and power source 28.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the method on an electronic device as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A system for performing speech enhancement using a Deep Neural Network (DNN)-based signal comprising:

a loudspeaker to output a loudspeaker signal, wherein the loudspeaker is being driven by a reference signal;

at least one microphone to receive at least one of: a near-end speaker signal, an ambient noise signal, or the loudspeaker signal and to generate a microphone signal;

an acoustic-echo-canceller (AEC) to receive the reference signal and the microphone signal, and to generate an AEC echo-cancelled signal;

a loudspeaker signal estimator to receive the microphone signal and the AEC echo-cancelled signal and to generate an estimated loudspeaker signal; and a deep neural network (DNN) to receive the microphone signal, the reference signal, the AEC echo-cancelled signal, and the estimated loudspeaker signal, and to generate a clean speech signal, wherein the DNN is trained offline by exciting the at least one microphone using a target training signal that includes a signal approximation of clean speech.

2. The system of claim 1, wherein the DNN generating the clean speech signal includes:

the DNN generating at least one of: an estimate of non-linear echo in the microphone signal that is not cancelled by the AEC, an estimate of residual echo in the microphone signal, or an estimate of ambient noise power level in the microphone signal, and the DNN generating the clean speech signal based on the estimate of non-linear echo in the microphone signal that is not cancelled by the AEC, the estimate of residual echo in the microphone signal, or the estimate of ambient noise power level.

3. The system of claim 1, wherein the DNN is one of a deep feed-forward neural network, a deep recursive neural network, or a deep convolutional neural network.

4. The system of claim 1, further comprising:

a time-frequency transformer to transform the microphone signal, the reference signal, the AEC echo-cancelled signal and the estimated loudspeaker signal from a time domain to a frequency domain, wherein the DNN receives and processes the microphone signal, the reference signal, the AEC echo-cancelled signal and the estimated loudspeaker signal in the frequency domain, and the DNN to generate the clean speech signal in the frequency domain; and a frequency-time transformer to transform the clean speech signal in the frequency domain to a clean speech signal in the time domain.

5. The system of claim 4, further comprising:

a plurality of feature processors, each feature processor to respectively extract and transmit features of the microphone signal, the reference signal, the AEC echo-cancelled signal and the estimated loudspeaker signal to the DNN.

6. The system of claim 5, wherein each of the feature processors include:

a smoothed power spectral density (PSD) unit to calculate a smoothed PSD, and a feature extractor to extract one of the features of the microphone signal, the reference signal, the AEC echo-cancelled signal and the estimated loudspeaker signal, a first normalization unit to normalize the smoothed PSD using a global mean and variance from training data, and a second normalization unit to normalize the extracted one of the features using a global mean and variance from the training data, and wherein the system further includes: a plurality of feature buffers to receive the normalized smoothed PSD and the normalized extracted feature from each of the feature processors, respectively, and to respectively buffer the extracted features with a number of past or future frames.

7. The system of claim 5, wherein the microphone signal, the reference signal, the AEC echo-cancelled signal and the estimated loudspeaker signal in the frequency domain are complex signals including a magnitude component and a phase component.

8. The system of claim 7, wherein each of the feature processors include:

a smoothed power spectral density (PSD) unit to calculate a smoothed PSD, and a feature extractor to extract one of the features of the microphone signal, the reference signal, the AEC echo-cancelled signal and the estimated loudspeaker signal, a first normalization unit to normalize the smoothed PSD using a global mean and variance from the training data, and a second normalization unit to normalize the extracted one of the features using a global mean and variance from training data, and wherein the system further includes: a plurality of feature buffers to receive the normalized smoothed PSD and the normalized extracted feature from each of the feature processors, respectively, and to respectively buffer the extracted features with a number of past or future frames.

9. A system for performing speech enhancement using a Deep Neural Network (DNN)-based signal comprising:

a loudspeaker to output a loudspeaker signal, wherein the loudspeaker is being driven by a reference signal;

at least one microphone to receive at least one of: a near-end speaker signal, an ambient noise signal, or the loudspeaker signal and to generate a microphone signal;

an acoustic-echo-canceller (AEC) to receive the reference signal and the microphone signal, and to generate an AEC echo-cancelled signal;

a loudspeaker signal estimator to receive the microphone signal and the AEC echo-cancelled signal and to generate an estimated loudspeaker signal; and a deep neural network (DNN) to receive the microphone signal, the reference signal, the AEC echo-cancelled signal, and the estimated loudspeaker signal, and to generate a speech reference signal that includes signal statistics for residual echo or signal statistics for noise, wherein the DNN is trained offline by exciting the at least one microphone using a target training signal that includes a signal approximation of clean speech.

10. The system of claim 9, wherein the speech reference signal that includes signal statistics for residual echo or signal statistics for noise includes at least one of: an estimate of non-linear echo in the microphone signal that is not cancelled by the AEC, an estimate of residual echo in the microphone signal, or an estimate of ambient noise power level in the microphone signal.

11. The system of claim 9, wherein the DNN is one of a deep feed-forward neural network, a deep recursive neural network, or a deep convolutional neural network.

12. The system of claim 9, further comprising:

a time-frequency transformer to transform the microphone signal, the reference signal, the AEC echo-cancelled signal and the estimated loudspeaker signal from a time domain to a frequency domain, wherein the DNN receives and processes the microphone signal, the reference signal, the AEC echo-cancelled signal and the estimated loudspeaker signal in the frequency domain, and the DNN to generate the speech reference in the frequency domain.

13. The system of claim 12, further comprising:

a noise suppressor to receive the AEC echo-cancelled signal and the speech reference in the frequency domain, to suppress noise or residual echo in the microphone signal based on the speech reference and to output a clean speech signal in the frequency domain; and a frequency-time transformer to transform the clean speech signal in the frequency domain to a clean speech signal in the time domain.

14. The system of claim 13, further comprising a plurality of feature processors, each feature processor to respectively extract and transmit features of the microphone signal, the reference signal, the AEC echo-cancelled signal and the estimated loudspeaker signal to the DNN.

15. The system of claim 14, wherein each of the feature processors include:

a smoothed power spectral density (PSD) unit to calculate a smoothed PSD, and a feature extractor to extract one of the features of the microphone signal, the reference signal, the AEC echo-cancelled signal and the estimated loudspeaker signal, a first normalization unit to normalize the smoothed PSD using a global mean and variance from training data, and a second normalization unit to normalize the extracted one of the features using a global mean and variance from the training data, and wherein the system further includes: a plurality of feature buffers to receive the normalized smoothed PSD and the normalized extracted feature from each of the feature processors, respectively, and to respectively buffer the extracted features with a number of past or future frames.

16. A method for performing speech enhancement using a Deep Neural Network (DNN)-based signal comprising:

training a deep neural network (DNN) offline by exciting at least one microphone using a target training signal that includes a signal approximation of clean speech;

driving a loudspeaker with a reference signal, wherein the loudspeaker outputs a loudspeaker signal;

generating by the at least one microphone a microphone signal based on at least one of: a near-end speaker signal, an ambient noise signal, or the loudspeaker signal;

generating by an acoustic-echo-canceller (AEC) an AEC echo-cancelled signal based on the reference signal and the microphone signal;

generating by a loudspeaker signal estimator an estimated loudspeaker signal based on the microphone signal and the AEC echo-cancelled signal;

receiving by the DNN the microphone signal, the reference signal, the AEC echo-cancelled signal, and the estimated loudspeaker signal; and generating by the DNN a speech reference signal that includes signal statistics for residual echo or signal statistics for noise based on the microphone signal, the reference signal, the AEC echo-cancelled signal, and the estimated loudspeaker signal.

17. The method of claim 16, wherein the speech reference signal that includes signal statistics for residual echo includes at least one of: an estimate of non-linear echo in the microphone signal that is not cancelled by the AEC, an estimate of residual echo in the microphone signal, or an estimate of ambient noise power level in the microphone signal.

18. The method of claim 17, further comprising:

generating by a noise suppressor a clean speech signal by suppressing noise or residual echo in the microphone signal based on speech reference signal.

* * * * *